US007108619B2

(12) United States Patent
Kavanaugh

(10) Patent No.: US 7,108,619 B2
(45) Date of Patent: Sep. 19, 2006

(54) HOCKEY STICK HANDLE

(76) Inventor: Gerald W. Kavanaugh, 635 Peele Blvd., Burlington, Ontario (CA) L7R 3B8

( * ) Notice: Subject to any disclaimer, the term of this patent is extended or adjusted under 35 U.S.C. 154(b) by 0 days.

(21) Appl. No.: 11/042,124

(22) Filed: Jan. 26, 2005

(65) Prior Publication Data

US 2005/0187046 A1 Aug. 25, 2005

Related U.S. Application Data

(60) Provisional application No. 60/538,470, filed on Jan. 26, 2004.

(51) Int. Cl.
*A63B 59/14* (2006.01)

(52) U.S. Cl. ..... 473/560

(58) Field of Classification Search ..... 473/560–563, 473/519, 520

See application file for complete search history.

(56) References Cited

U.S. PATENT DOCUMENTS

| | | | | |
|---|---|---|---|---|
| 4,358,113 | A * | 11/1982 | McKinnon et al. | 473/561 |
| 6,033,327 | A * | 3/2000 | Bird | 473/560 |
| 6,113,508 | A * | 9/2000 | Locamo et al. | 473/516 |
| 6,257,997 | B1 * | 7/2001 | Doble et al. | 473/516 |
| 6,361,451 | B1 * | 3/2002 | Masters et al. | 473/318 |
| 6,939,257 | B1 * | 9/2005 | Tiitola | 473/561 |
| 6,942,587 | B1 * | 9/2005 | Lussier et al. | 473/561 |
| 2002/0037780 | A1 * | 3/2002 | York et al. | 473/560 |
| 2004/0102263 | A1 * | 5/2004 | Blotteaux | 473/561 |

* cited by examiner

*Primary Examiner*—Mark S. Graham
(74) *Attorney, Agent, or Firm*—Robert F. Delbridge

(57) ABSTRACT

A hockey stick handle has an inner shaft member which provides flexing characteristics and an outer tubular member in which the inner shaft member is fitted and which provides protection for the inner shaft member.

10 Claims, 3 Drawing Sheets

HOCKEY STICK HANDLE

RELATED APPLICATION

This application claims priority from U.S. Provisional Patent Application Ser. No. 60/538470 filed Jan. 26, 2004.

FIELD OF INVENTION

This invention relates to hockey stick handles.

BACKGROUND OF THE INVENTION

For many years, hockey sticks have been made with wooden handles. Relatively recently however, hockey stick handles have been made of carbon fiber composite material. Although such handles have various advantages over wooden handles, they are relatively expensive and tend to break during use, with consequent expense to the player or his or her team.

It is therefore an object of the invention to provide a hockey stick with a handle which has substantially all the advantages of a carbon fiber handle, but which has a reduced tendency to break during use.

SUMMARY OF THE INVENTION

According to the invention, a hockey stick handle has an inner shaft member of carbon fiber or other material which provides the required resilient flexing characteristics and an outer tubular member in which the inner shaft member is fitted and which provides protection for the inner shaft member. The inner shaft member may also be tubular for weight reducing purposes. The outer tubular member may be of rectangular section, with the inner shaft member having at least its end portions of similar section dimensioned to be a sliding fit in the outer tubular member. Alternatively, the outer tubular member may be molded onto the inner shaft member.

There may be an annular space between the outer tubular member and the inner shaft member which is at least partially filled with a shock absorbing foamed material.

A hockey blade may be secured to the inner shaft member or may be integral therewith.

BRIEF DESCRIPTION OF THE DRAWINGS

One embodiment of the invention will now be described, by way of example, with reference to the accompanying drawings, of which.

DESCRIPTION OF PREFERRED EMBODIMENT

Figure 1:
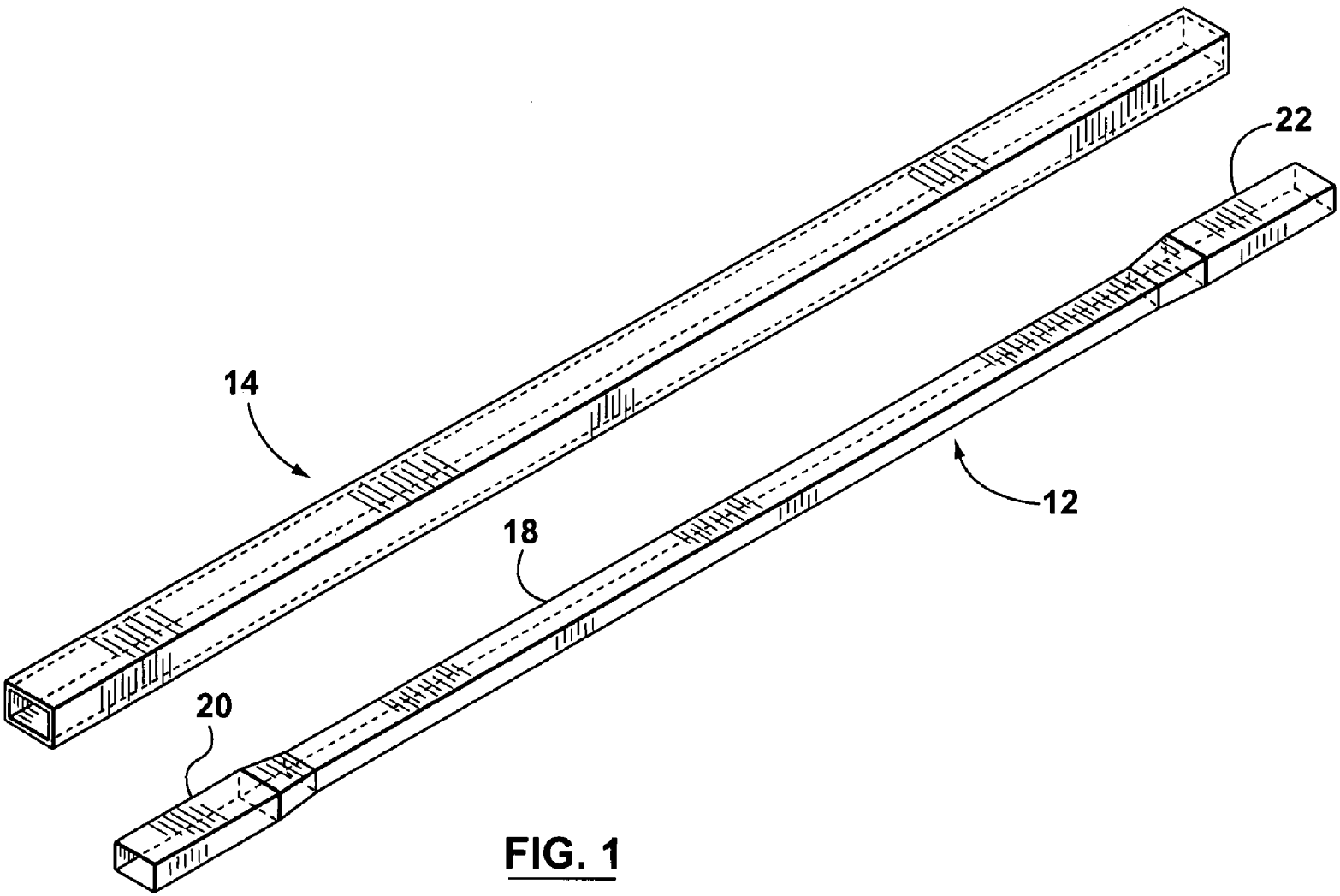
FIG. 1 is a perspective view of the inner and outer members of a hockey stick handle in accordance with one embodiment of the invention before assembly.

Referring to the drawings, a hockey stick handle 10 has an inner tubular shaft member 12 of carbon fiber with a rectangular section. The inner tubular shaft member 12 is constructed to provide the required resilient flexing requirements of a hockey stick handle. The handle 10 also has an outer tubular member 14 of Kevlar/S-Glass and rectangular section.

Figure 2:
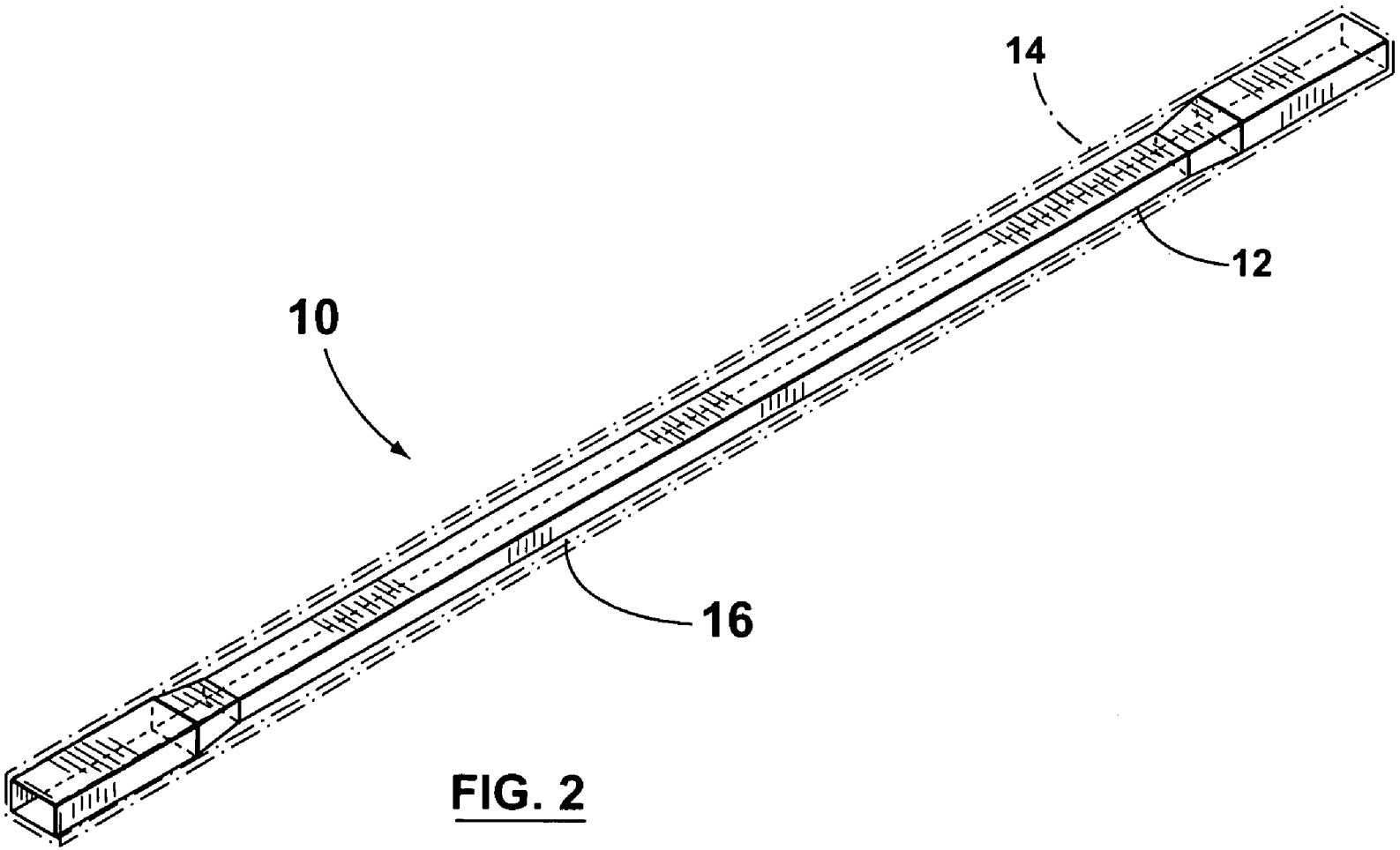
FIG. 2 is a similar view showing the inner and outer members assembled to form a hockey stick handle.

The inner tubular shaft member is assembled with the outer tubular member 14 by sliding the inner tubular shaft member 12 into the outer tubular member 14 as shown in FIG. 2. A longitudedly-extending annular space 16 between the inner shaft member 12 and the outer tubular member 14 is filled with foamed material, such as Corecell foam.

It will be noted that, in this embodiment, the medial portion 18 of the length of the inner shaft member 12 is of reduced dimensions compared to the end portions 20, 22 to provide the foam filled space 16. The medial portion 18 may be rectangular as shown, or may be circular. The end portions 20, 22 are rectangular and shaped to be a sliding fit in the outer tubular member 14.

Figure 3:
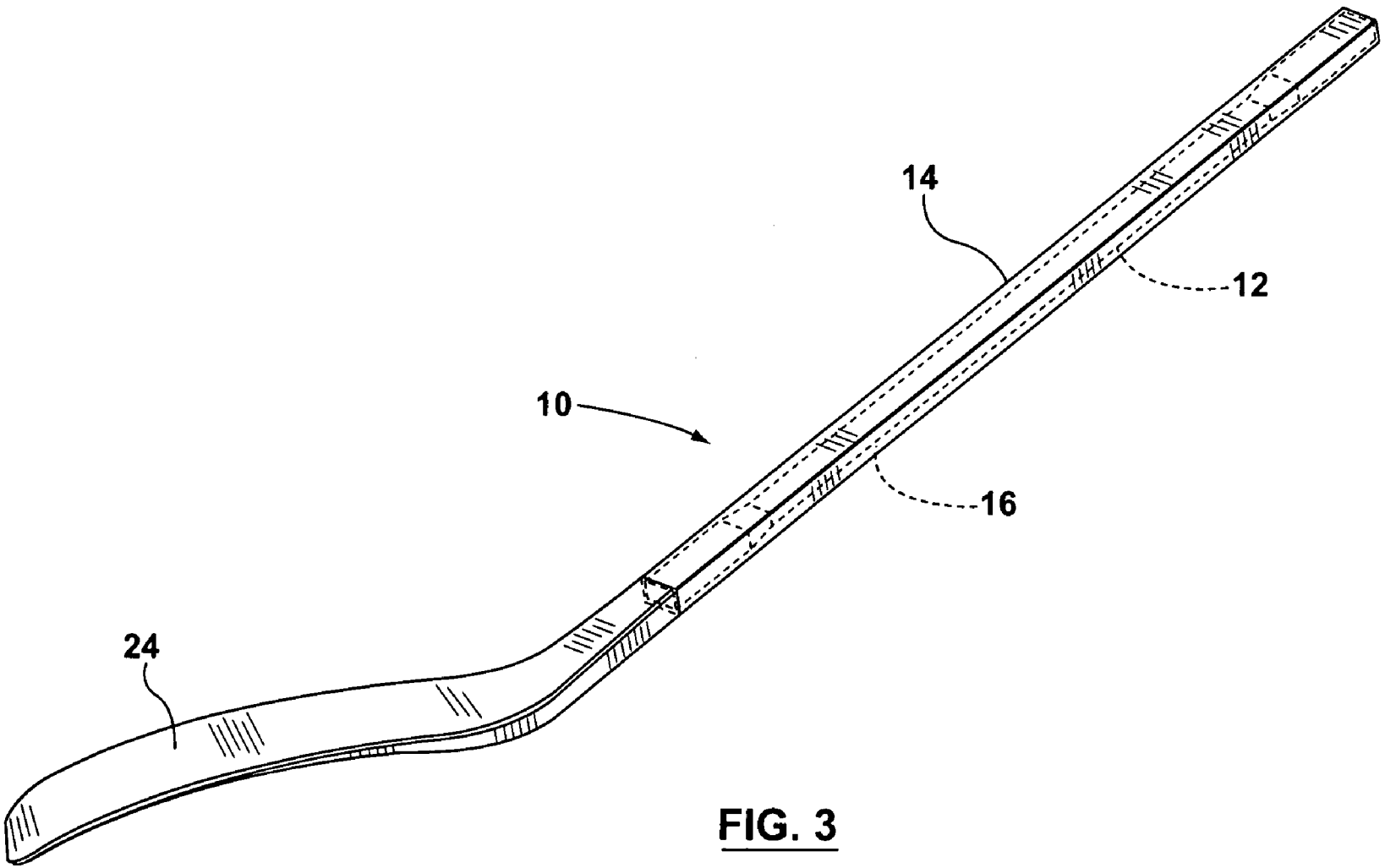
FIG. 3 is a similar view (but not to scale) showing a hockey blade secured to the handle.

A hockey stick blade 24, see FIG. 3, may be secured to the end portion 20 of the inner shaft member 12 or may be integral therewith.

In use, the inner shaft member 12 provides the required resilient flexing characteristics and the outer tubular member 14 protects the inner shaft member 12. The foamed material in the space 16 between the medial portions of the length of the inner and outer tubular members 12, 14 provides a shock absorbing capability.

Instead of the inner tubular member being a sliding fit in the outer tubular member, the outer tubular member may be molded onto the inner tubular member.

Other advantages and embodiments of the present invention will now be readily apparent to a person skilled in the art from the foregoing description of a preferred embodiment, the scope of the invention being defined in the appended claims.

The invention claimed is:

1. A hockey stick handle having an inner shaft member providing flexing characteristics said inner shaft member having a medial portion of reduced dimensions compared to its end portions, an outer tubular member in which the inner shaft member is fitted and which provides protection for the inner shaft member, said outer tubular member and said medial portion of the inner shaft member defining an annular space between the outer tubular member and the inner shaft member, and shock absorbing material filling said annular space.

2. A hockey stick handle according to claim 1 wherein the inner shaft member is tubular.

3. A hockey stick handle according to claim 1 wherein the outer tubular member is of rectangular section.

4. A hockey stick handle according to claim 3 wherein the inner shaft member has at least its end portions of similar section to the outer tubular member and dimensioned to be a sliding fit in the outer tubular member.

5. A hockey stick handle according to claim 1 wherein the medial portion of the inner shaft member is of rectangular section.

6. A hockey stick handle according to claim 1 wherein the medial portion of the inner shaft member is of circular section.

7. A hockey stick handle according to claim 1 wherein the outer tubular member is molded onto the inner shaft member.

8. A hockey stick handle according to claim 1 wherein the shock absorbing material is foamed material.

9. A hockey stick having a handle in accordance with claim 1 and a hockey stick blade secured to the inner shaft member.

10. A hockey stick having a handle in accordance with claim 1 and a hockey stick blade integral with the inner shaft member.

* * * * *